United States Patent [19]

Abrahams et al.

[11] 4,045,978

[45] Sept. 6, 1977

[54] HOT-GAS RECIPROCATING MACHINE

[75] Inventors: Jacobus Hubertus Abrahams; Joannes Jacobus Maria Collette; Robertus Aloysius Tarcisius Johannes Walters, all of Eindhoven, Netherlands

[73] Assignee: U.S. Philips Corporation, New York, N.Y.

[21] Appl. No.: 692,126

[22] Filed: June 2, 1976

Related U.S. Application Data

[63] Continuation of Ser. No. 582,352, May 30, 1975, abandoned.

[30] Foreign Application Priority Data

June 14, 1974 Netherlands ..... 7407951

[51] Int. Cl.[2] ..... F02G 1/04; F02G 1/06

[52] U.S. Cl. ..... 60/521; 60/522; 60/525

[58] Field of Search ..... 60/517–526

[56] References Cited

U.S. PATENT DOCUMENTS

| | | | |
|---|---|---|---|
| 3,546,877 | 12/1970 | Beukering et al. | 60/521 X |
| 3,807,176 | 4/1974 | Hankansson | 60/525 |

*Primary Examiner*—Allen M. Ostrager

*Attorney, Agent, or Firm*—Frank R. Trifari; David R. Treacy

[57] ABSTRACT

A hot-gas reciprocating machine having a plurality of working spaces connected via ducts to a common control member for controlling working medium flows to the working spaces from a source of pressurized working medium. The control member comprises a stator and a rotor coupled to the crank shaft of the machine, with flow of the working medium being controlled by valves sequentially opened by rotation of said rotor.

8 Claims, 2 Drawing Figures

HOT-GAS RECIPROCATING MACHINE

This is a continuation, of application Ser. No. 582,352, filed May 30, 1975, now abandoned.

BACKGROUND OF THE INVENTION

The invention relates to a hot-gas reciprocating machine, comprising a plurality of working spaces, the volumes of which can be varied at a phase difference with respect to each other by pistons which are coupled to a crank shaft. A working medium in each of the working spaces performs a thermodynamic cycle during operation; each of the working spaces is connected, via an associated connection duct including a non-return valve which opens in the direction of the relevant working space, to a main supply duct for working medium in which a closing member is provided, the main supply duct being connected to a source of pressurized working medium. A hot-gas reciprocating machine of the kind set forth is known from U.S. Pat. No. 3,546,877.

Within the scope of the present application, hot-gas reciprocating machines are to be understood to mean hot-gas reciprocating engines, cold-gas refrigerators and heat pumps. In each of these machines the working medium in the working space is alternately compressed when it is mainly present in a sub-space, the compression space, is subsequently transported, via a regenerator, to a further subspace, the expansion space, after which, when the working medium is mainly present in the expansion space, it is expanded, and finally it is returned, via the regenerator, to the compression space to complete the cycle. The compression space and the expansion space have different mean temperatures with respect to each other during operation. The pistons which vary the volumes of the different working spaces are coupled to the crank shaft at a different crank angle with respect to each other. Consequently, a phase difference exists as regards the volume variation and the pressure variation occurring in each working space.

The power of the machine can be increased by increasing the quantity of working medium in the various working spaces of the machine. Notably, in hot-gas reciprocating engines for traction purposes, particularly at low speeds and powers, when a sudden power increase is desired, for example, in the case of acceleration, it is advantageous to supply working medium to each of the working spaces at the instant at which the working medium participating in the thermodynamic cycle in the relevant working space reaches substantially the highest pressure occurring during the cycle. This is because the highest pressure of the working medium then increases, so that the supplied working medium directly participates in the expansion without the engine first having to perform work of compression on the added working medium. In this way we prevent the engine torque from being initially decreased, (a braking effect). Consequently, when the supply of working medium takes place at maximum cycle pressure, the engine immediately delivers a higher power.

The supply of working medium to the sole working space of a hot-gas reciprocating machine exclusively during the period in which the maximum cycle pressure occurs in the said working space, is known from U.S. Pat. No. 2,616,244. Therein, a valve which is mechanically controlled by the machine is periodically opened, with the result that the working space is periodically brought in open communication with the working medium source. A construction of this kind is unattractive for the present machine comprising a plurality of working spaces, because of the fact that a large number of valves is required, each of which is to be opened at an individual instant, because in the thermodynamic cycles the maximum pressure occurs at mutually different instants.

The supply of working medium exclusively at maximum cycle pressure also involves a drawback. In order to enable working medium to be continuously supplied to the working space at the ever increasing maximum cycle pressure during the periodic supply, the working medium in the source should be under a very high pressure. This means that the commonly used compressor of the power control system must have a very high compression rate. An expensive compressor of high power is thus required.

SUMMARY OF THE INVENTION

The present invention has for its object to provide a hot-gas reciprocating machine of the kind set forth, in which fast power increases of the machine are realized in a structurally very simple manner, without very high pressures of the working medium in the source being required, so without a heavy high-power compressor being required.

The hot-gas reciprocating machine according to the invention is characterized in that between the connection ducts and the main supply duct there is included a control member which is provided with a stator and a rotor which is rotatable with respect thereto and which is coupled to the crank shaft; the said rotor is slidable in the rotation axial direction and comprises at least one duct, each connection duct being individually connected to an associated first port through the stator, the main supply duct being connected to a second port through the stator. During the supply of working medium to the working spaces the rotor continuously axially subject to a pressure on the one side, which corresponds to an instantaneous cycle pressure which periodically occurs in a working space, and on the other side, to the source pressure. The control member is furthermore adapted such that in the case of a lower level of the instantaneous cycle pressure, the rotor occupies an axial position in which during each revolution of the crank shaft, the rotor successively brings each of the first ports separately into open communication with the second port, each time for the period in which the maximum cycle pressure occurs in the interconnected working space; in the case of a higher level of the instantaneous cycle pressure the rotor occupies a different axial position in which all first ports are continuously in open communication with the second port. For the instantaneous cycle pressure, use can be made of, for example, the minimum, the mean or the maximum cycle pressure.

It is thus achieved that, when the closing member opens, initially working medium is supplied to each working space at each revolution of the crank shaft for the period during which the maximum cycle pressure occurs in the relevant working space, while subsequently, due to the increasing continuous pressure representing the instantaneous cycle pressure acting on one side of the rotor, and the decreasing source pressure which acts on the other side of the rotor, the rotor gradually assumes a new axial position, so that all first ports in the stator are brought into open communication with the second port. In the latter case, also because of the presence of the non-return valves in the connection ducts, for each working space automatically a gradual transition takes place from supply of working medium at maximum cycle pressure to supply at minimum cycle pressure. The non-return valves also ensure that the different cycles having a different phase relative to each other, remain separated.

It is to be noted that from U.S. Pat. No. 2,616,243 that a hot-gas reciprocating machine is known, for the control of the quantity of working medium participating in the cycle in the working space, by use of a control member of the kind which comprises a stator and an axially slidable rotor which is coupled to the crank shaft of the machine. However, this concerns a machine having only one working space which can be successively brought into communication via the control member with two different working medium reservoirs of mutually different, substantially constant pressures. The sliding of the rotor therein is effected by hand or by means of a regulator. In the machine according to the present invention, however, a plurality of working spaces with cycles of mutually different phase are all connected, via only one common control member, to one and the same working medium source. The rotor is slid therein under the influence of varying working medium pressures acting on the rotor on both sides of the rotor, the arrangement being such that after initial supply of working medium to each working space exclusively during the period of maximum cycle pressure, a gradual transition occurs to supply at minimum cycle pressure.

The invention will be described in detail hereinafter with reference to the diagrammatic drawing which is not to scale.

DETAILED DESCRIPTION OF THE PREFERRED EMBODIMENT

Figure 1:
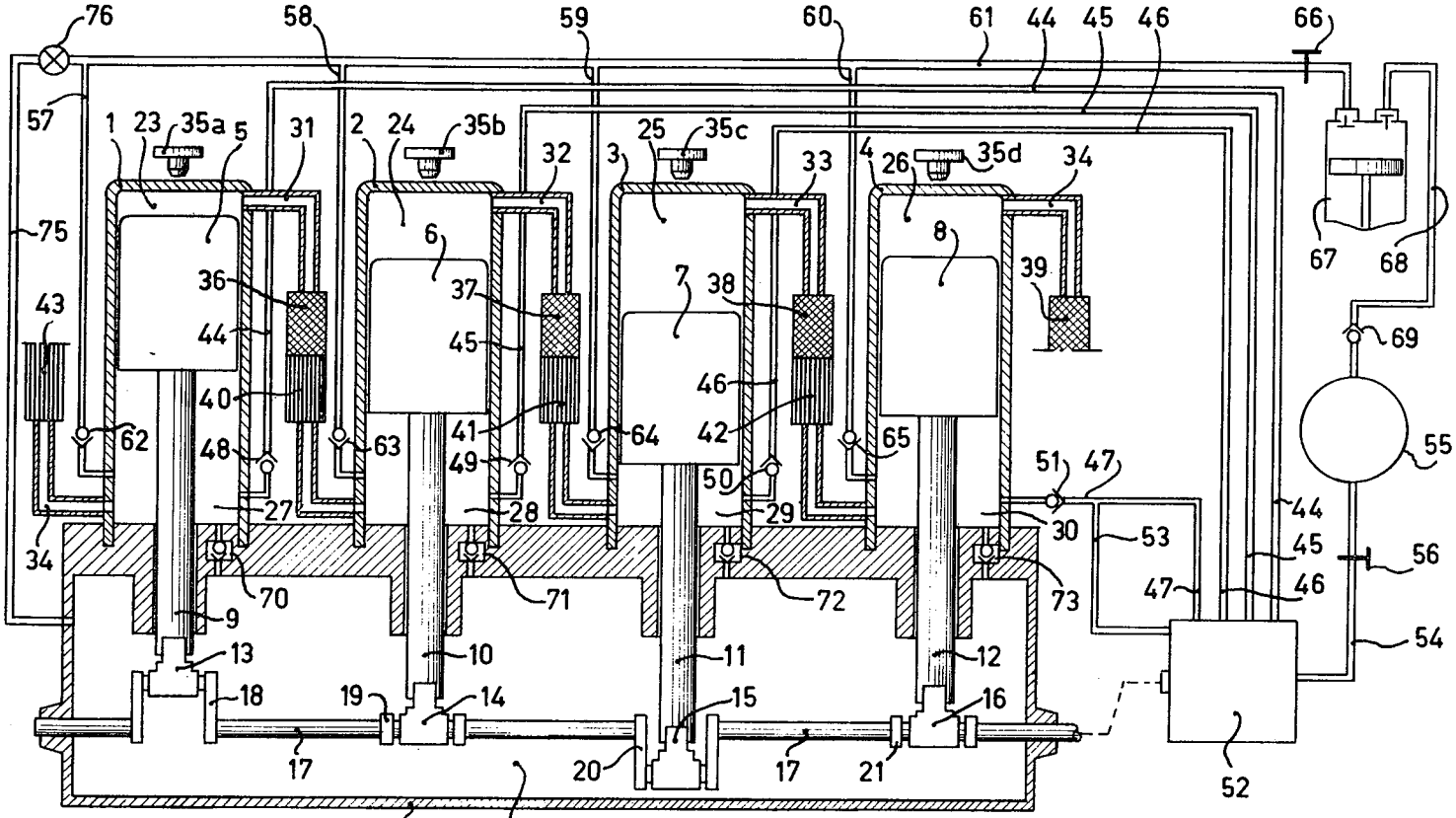
FIG. 1 is a longitudinal sectional view of a 4-cylinder double-acting hot-gas engine comprising a power control device.

The reference numerals 1, 2, 3 and 4 in FIG. 1 denote the cylinders in which the pistons 5, 6, 7 and 8 are reciprocatable. The pistons are connected, via piston rods 9 - 12 and drive rods 13 - 16, to a crank shaft 17; the cranks 18 - 21 are arranged at with respect to each other, such that the desired phase difference in the motion of the pistons is achieved. Crank shaft 17 passes through the wall of a crank case 22.

The upper end faces of the pistons 5 - 8 vary the volume of the expansion spaces 23, 24, 25 and 26, respectively, and their lower end face vary the volume of the compression spaces 27, 28, 29 and 30, respectively.

Expansion space 23 inside cylinder 1 and compression space 28, connected thereto by way of a duct 31 inside cylinder 2, together constitute a working space in which a thermodynamic cycle is completed. Further working spaces are formed by expansion space 24 and compression space 29, interconnected by way of duct 32; expansion space 25 and compression space 30, interconnected by way of duct 33; and expansion space 26 inside cylinder 4 and compression space 27 inside cylinder 1, interconnected by way of duct 34.

The working medium of the four different cycles receives external heat in the expansion spaces 23 - 26 from burners 35*a–d.* Each of the connection ducts 31 - 34 includes a regenerator 36, 37, 38 and 39, respectively, and a cooler 40, 41, 42 and 43, respectively.

Each of the compression spaces 27 to 30 has connected thereto a connection duct 44, 45, 46 and 47, respectively, incorporating a non-return valve 48, 49, 50 and 51, respectively, which opens in the direction of the relevant working space. The other end of each connection duct is separately connected to a control member 52, which will be described in detail hereinafter with reference to FIG. 2 and which comprises a rotor which is coupled to the crank shaft 17. The portion of the connection duct 47 which is situated between non-return valve 51 and control member 52 has connected thereto a minimum pressure duct 53, the other end of which is also connected to control member 52.

Control member 52 also has connected thereto a main supply duct 54 for working medium, the other end of which is connected to a supply vessel 55 for pressurized working medium. The main supply duct 54 includes a valve 56. Each of the compression spaces 27 to 30 also has connected thereto a discharge duct 57, 58, 59 and 60, respectively. The discharge ducts open into a main discharge duct 61. Each of the discharge ducts 57 to 60 includes a non-return valve 62, 63, 64, 65, respectively, which opens in the direction of the main discharge duct 61.

Main discharge duct 61, including a valve 66, is connected to the inlet side of a compressor 67. The outlet side of compressor 67 is connected, via a high-pressure duct 68 which includes a non-return valve 69 which opens in the direction of the supply vessel 55, to the said supply vessel.

Finally, each of the compression spaces 27 to 30 communicates with crank case space 74 via a non-return valve 70, 71, 72 and 73, respectively, which opens in the direction of the relevant space and which is accommodated in the wall of crank case 22. Between crank case space 74 and main discharge duct 61 there is provided a by-pass duct 75 in which a control valve 76 is incorporated.

Figure 2:
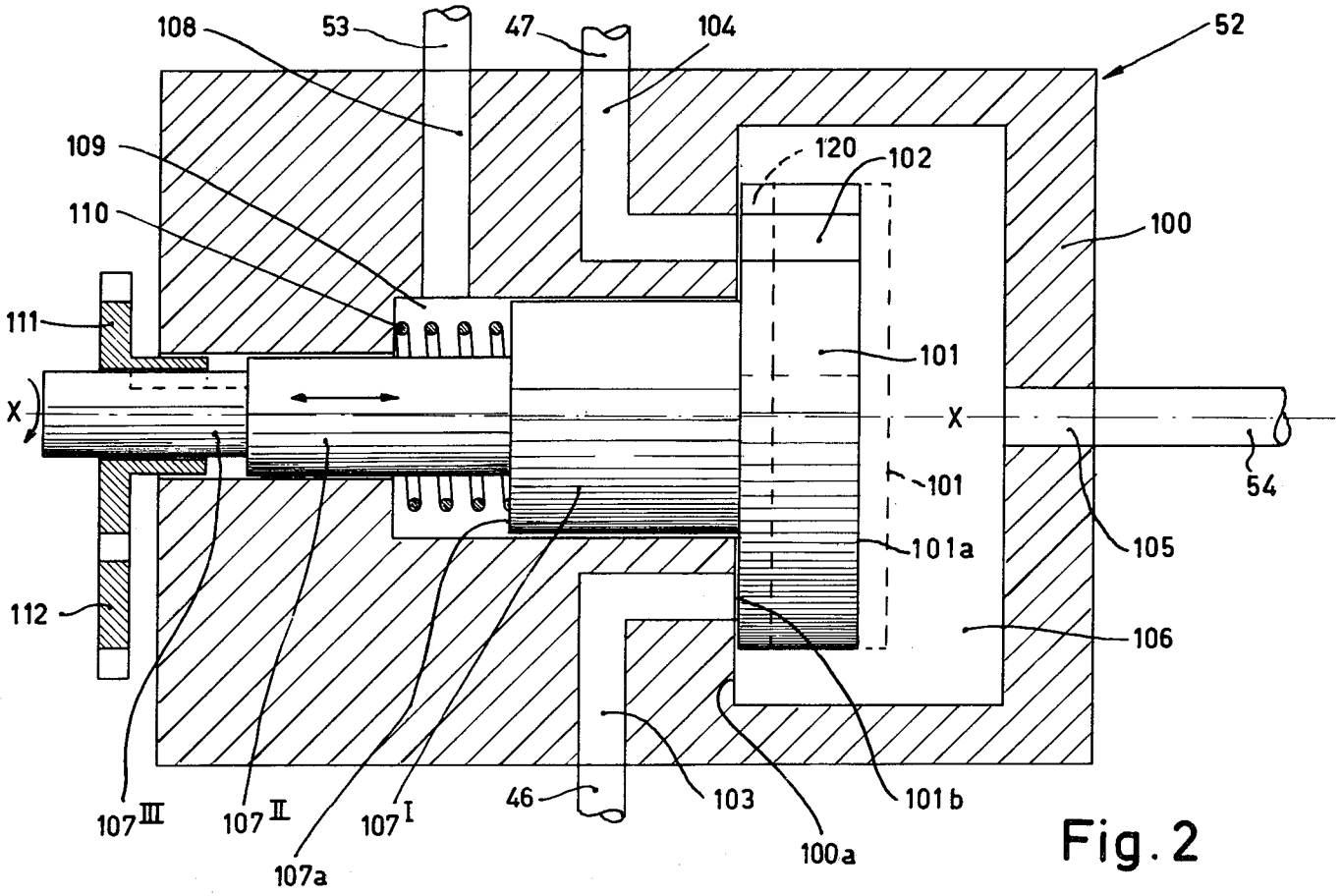
FIG. 2 is a longitudinal section view of an embodiment of the control member.

The control member according to FIG. 2 comprises a stator 100 within which a rotor 101 is arranged to be rotatable about and slidable along the axis X—X. The rotor 101 is provided with a bore 102. The stator is provided with four first ports which are distributed over the stator circumference at an angle of 90° with respect to each other, two of the said first ports being visible in the longitudinal sectional view, denoted by the references 103 and 104. The port 103 has the connection duct 46 of FIG. 1 connected thereto, and the connection duct 47 is connected to the port 104. The connection ducts 44 and 45 are separately connected to the other two first ports which are not visible in FIG. 2. A second port 105 through the stator 100 connects the main supply duct 54 of FIG. 1 to a chamber 106 inside the stator 100.

Rotor 101 is connected to a rod which is composed of three portions of different diameters $107^{I}$, $107^{II}$ and $107^{III}$. Port 108 through the stator 100 connects the minimum pressure duct 53 of FIG. 1 to chamber 109 inside the stator, the said chamber accommodating a compression spring 110. Rotor 101 is made to rotate at the same speed as the crank shaft 17 of FIG. 1 by means of gearwheels 111 and 112. Rod portion $107^{III}$ can slide along the axis X—X in the gearwheel 111, this gearwheel 111 taking along, by means of a key, the rod portion $107^{III}$ and hence the rotor 101 in the rotary movement.

The supply of working medium to the working spaces of the hot-gas engine so as to increase the power delivered by the engine, will now be described in detail on the basis of the following situation. Valves 56 and 66 and the control valve 76 are in the closed position. Compressed working medium is present in supply vessel 55. The hot-gas engine is in operation and delivers a low power at low mean working medium pressures in the four working spaces. In the portions of the connection ducts 44 to 47, situated on the sides of the associated non-return valves 48 to 51 which are remote from the compression spaces 27 to 30, and in the duct 53, the minimum pressure of the varying cycle pressure occurring in the associated working space then prevails. At the same time, the maximum cycle pressure prevails in the portions of the discharge ducts 57 to 60, situated on the sides of the associated non-return valves 62 to 65 which are remote from the compression spaces 27 to 30, and in the main discharge duct 61.

If the power delivered by the engine is to be increased, the valve 56 is opened and compressed working medium flows from supply vessel 55 to chamber 106 via main supply duct 54 and port 105. On rotor end face 101*a* this working medium exerts a pressure which exceeds the pressure on annular rod face 107*a,* exerted by spring 110 and the working medium of minimum cycle pressure in chamber 109. Rotor end face 101*b* then bears on stator face 100*a.* The four first ports, including the ports 103 and 104 shown, are then mutually sealed. Rotor 101 is coupled to the crank shaft 17 such that upon each revolution of the crank shaft each of the four first ports 103, 104 etc. is successively individually brought into communication, via bore 102, with chamber 106, each time for the period during which the maximum cycle pressure occurs in the working space interconnected at that instant. Compressed working medium then flows for a period of open communication from chamber 106, via boring 102, to port 104 (FIG. 2), and further, via connection 47 and non-return valve 51, to compression space 30. Because working medium is supplied to each working space for the period of the relevant cycle in which the pressure is maximum, the power of the engine immediately increases.

Because working medium is periodically supplied from supply vessel 55 to the four working spaces, the pressure level in the supply vessel 55 gradually decreases and the pressure level in the working spaces increases, and hence also the level of the minimum cycle pressure in duct 53. As a result, at a given instant, after the engine has already achieved the desired fast power increase, the working medium in chamber 109 which is now of a higher minimum cycle pressure level exerts, together with spring 110, a force on rod end face 107*a* which overcomes the force exerted on rotor end face 101*a* by the working medium which is present in chamber 106 and which now has a lower pressure level. Consequently, rotor 101 gradually slides to the right and all four first ports 103, 104 etc. will be continuously in open communication, via gap 120 and via bore 102, with chamber 106 and port 105. The rotor 101 in the shifted position is denoted by broken lines. In the new axial rotor position, working medium flows from supply vessel 55 to each of the working spaces for the period during which the cycle pressure occurring in the relevant working space is lower than the pressure in chamber 106, because the non-return valves 48 to 51 will then each time be open. As the pressure in chamber 106 decreases and the mean pressure in the working spaces increases, the period during which the non-return valves 48 to 51 are open will decrease, and the situation can be reached in which still only little working medium flows to a working space during the period in which the (then comparatively high) minimum cycle pressure prevails in the said working space.

For the sake of completeness it will yet be described how a fast decrease of the power supplied by the engine can be realized. To this end, valve 56 is closed and valve 66 and control valve 76 are opened. On the one side, working medium starts to flow from discharge ducts 57 to 60, via by-pass duct 75, to the crank case space 74 and further, via the non-return valves 70 to 73, to the four cycles, with the result that, due to phase shifts, the P-V diagrams are adversely affected and power is reduced. On the other side, compressor 67 draws working medium from the working spaces via discharge ducts 57 to 60 and main supply duct 61, the working medium being forced into the supply vessel 55 via non-return valve 69.

It is to be noted that all sorts of variations of the control member 52 are feasible. For example, bore 102 can be replaced by a recess in the rotor circumferential wall. It is alternatively possible, for example, to make rotor ducts which radially open into the rotor circumferential wall cooperate with radial ports through the stator.

What is claimed is:

1. A hot-gas reciprocating machine, comprising a plurality of working spaces, the volumes of which can be varied at a phase difference with respect to each other by piston-like bodies which are coupled to a crank shaft, a working medium in each of the said working spaces performing a thermodynamic cycle during operation, each of the working spaces being connected, via an associated connection duct including a non-return valve which opens in the direction of the relevant working space, to a main supply duct for working medium in which a closing member is provided, the said main supply duct being connected to a source of pressurized working medium, characterized in that between the connection ducts and the main supply duct there is included a control member which is provided with a stator and a rotor which is rotatable with respect thereto and which is slidable in the rotation axial direction, the said rotor being coupled to the crank shaft and comprising at least one duct, each connection duct being individually connected to an associated first port through the stator, the main supply duct being connected to a second port through the stator, during the supply of working medium to the working spaces the rotor being continuously axially subject in an opposite sense to on the one side a pressure which corresponds to an instantaneous cycle pressure which periodically occurs in a working space, and on the other side to the source pressure, the control member being furthermore adapted to such that in the case of a lower level of the instantaneous cycle pressure the rotor occupies an axial position in which during each revolution of the crank shaft the rotor successively brings each of the first ports separately into open communication with the second port, each time for the period in which the maximum cycle pressure occurs in the interconnected working space, and that in the case of a higher level of the instantaneous cycle pressure the rotor occupies a different axial position in which all first ports are continuously in open communication with the second port.

2. In a hot-gas reciprocating machine operable with a source of pressurized working medium, and including a housing defining therein a plurality of working spaces with a piston in each of said spaces, the pistons being reciprocated at a variable rate and at a predetermined phase difference relative to each other, and means selectively for supplying working medium from said source to said working spaces, and for removing working medium from said working spaces, respectively for increasing and decreasing the mean pressure of the medium in said working spaces, the improvement in combination therewith of a control member for controlling the flow of said medium to and from said plurality of working spaces, comprising a housing including an inlet communicating with said source of working medium, a plurality of outlets, each communicating with one of said working spaces, a rotor rotatable in said housing, means for rotating said rotor at a rate corresponding to said reciprocation of said pistons, said rotor also being movable between first and second axial positions, first valve means operable by said rotor when in its first position, for communicating said inlet duct successively with one at a time of said outlet ducts corresponding to the phase difference of said pistons, and second valve means operable by said rotor in its second position, for communicating said inlet duct continuously with all of said working spaces at once.

3. Apparatus according to claim 2 wherein each working space comprises an expansion space and a compression space, and said source of working medium comprises a supply vessel of said medium and a compressor having an outlet communicating with said vessel and an inlet, and said control means further comprises a connection duct communicating each of said compression spaces with one of said control member outlets and a one-way valve in each connection duct allowing said medium flow only into a compression space, a discharge duct communicating each of said compression spaces with said compressor inlet, and a one-way valve in each of said discharge ducts allowing said medium flow only out of a compression space.

4. Apparatus according to claim 3 which includes a crankcase space, the control member further comprising a by-pass duct for communicating said discharge ducts with said crankcase space, an on-off valve in said by-pass duct, a further duct communicating each of said compression spaces with said crankcase space, and a one-way valve in each of said further ducts allowing flow of said medium only out of said compression space.

5. Apparatus according to claim 2 wherein said control member further comprises spring means urging said rotor into its second axial position, and a control port communicating one of said connection ducts downstream of the one-way valve therein with said rotor urging same toward said second axial position, said working medium from said control member housing inlet urging said rotor toward its first position, said rotor being moved to its first position when said medium pressure from the source thereof is greater than the force from said spring force and the medium in said control port.

6. Apparatus according to claim 2 operable as a hot-gas engine according to the Stirling Thermodynamic cycle.

7. In a hot-gas reciprocating machine operable with a source of pressurized working medium, and including a housing defining therein a plurality of working spaces with a piston in each of said spaces, the pistons being reciprocated at a variable rate and at a predetermined phase difference relative to each other, and means selectively for supplying working medium from said source to said working spaces, and for removing working medium from said working spaces, respectively for increasing and decreasing the mean pressure of the medium in said working spaces, the improvement in combination therewith of a control member for controlling the flow of said medium to and from said plurality of working spaces, comprising a housing including an inlet communicating with said source of working medium, a plurality of outlets, each communicating with one of said working spaces, a control element movable in said housing between first and second positions thereof, first valve means operable by said element when in its first position, for communicating said inlet duct successively with one at a time of said outlet ducts, corresponding to the phase difference of said pistons, and second valve means operable by said element in its second position, for communicating said inlet duct continuously with all of said working spaces at once.

8. Apparatus according to claim 7 operable as a hot-gas engine according to the Stirling Thermodynamic cycle.

* * * * *